US005983533A

United States Patent [19]

Bitelli

[11] Patent Number: 5,983,533

[45] Date of Patent: Nov. 16, 1999

[54] SCARIFER MACHINE WITH A SHAKING MILLING DRUM

[75] Inventor: Romolo Bitelli, Minerbio, Italy

[73] Assignee: Bitelli spa, Minerbio, Italy

[21] Appl. No.: 09/141,508

[22] Filed: Aug. 27, 1998

[30] Foreign Application Priority Data

Sep. 3, 1997 [IT] Italy ..... VI97A0145

[51] Int. Cl.[6] ..... E01C 19/28

[52] U.S. Cl. ..... 37/189; 172/40; 172/94; 172/97

[58] Field of Search ..... 172/94, 93, 97, 172/40; 37/189

[56] References Cited

U.S. PATENT DOCUMENTS

| | | | |
|---|---|---|---|
| 2,014,792 | 9/1935 | Weimer | 37/189 |
| 2,616,347 | 11/1952 | Wallace | 172/94 X |
| 2,659,585 | 11/1953 | McCallum | 37/189 X |
| 3,611,730 | 10/1971 | Brettrager | 172/40 X |
| 4,278,368 | 7/1981 | Livesay | 172/40 X |
| 4,913,581 | 4/1990 | Weiler | 172/40 X |
| 5,029,652 | 7/1991 | Whitfield | 172/97 X |
| 5,203,101 | 4/1993 | Bryan | 37/189 |
| 5,526,590 | 6/1996 | Palm et al. | 172/40 X |

*Primary Examiner*—Christopher J. Novosad

*Attorney, Agent, or Firm*—Watson Cole Grindle Watson P.L.L.C.

[57] ABSTRACT

A scarifier machine has a milling drum partially enclosed in a protective sump which is suspended from the frame of the machine by a linkage assembly. An eccentric drive reciprocates the sump relative to the frame.

5 Claims, 6 Drawing Sheets

SCARIFER MACHINE WITH A SHAKING MILLING DRUM

BACKGROUND OF THE INVENTION

The invention concerns a scarifier machine for the removal of soils.

As it is known the scarifiers are machines which are used for the removal of soils, for example in order to execute excavations or to crumble and to remove road blankets.

Such scarifier machines substantially comprise a frame mounted on wheels or tracks, supplied with a propelling group, a driving place on which the driver is seated and a milling drum on which active elements which are put in contact with the soil to be removed are present.

The milling drum is covered by a protective sump and it is set in rotation in order that the active elements with which it is provided can execute the crumbling of the soil with which they come in contact and in which they are made to sink.

In the embodiments belonging to the known technique the milling drum is supplied with a primary motion which is the rotation around its own longitudinal axis while the feeding movement is a progressive shifting which makes it to sink in the ground.

SUMMARY OF THE INVENTION

The present invention intends to realise a scarifier machine in which the milling drum is supplied also with a shaking movement, formed of speedy alternating movements in comparison with the soil to be worked, which are created during its rotation around its own longitudinal axis.

The said purpose is achieved by the realisation of a scarifier machine for the removal of soils which, according to the main claim comprises:

- a frame mounted on wheels or on tracks which supports a propelling group and it is provided with at least a driving place which accommodates at least a driver;
- at least a milling drum supplied with active elements put in contact with the soil to be removed and with a protective sump mechanically connected with said frame;
- first motorization means mechanically connected with said milling drum and suitable for setting it in rotation around its longitudinal axis and it is wherein said protective sump is mechanically connected with said frame by shaking means, which cooperate with second motorization means, in order to impart to said sump and to said drum connected with it alternating movements in comparison with said soil to be worked during the rotation of the milling drum itself.

According to a preferred embodiment said shaking means are formed of one or more cylindrical shafts arranged in between supports fixed to said sump and supplied with eccentric cylindrical zones in which supports fixed to the frame of said machine are coupled. When said shaft is set in rotation by said second motorization means, said eccentric zones realise the shaking of said drum which is the combination of a sussultatory motion on a vertical plane with an undulatory motion on a horizontal plane.

According to another embodiment said shifting means are formed by hydraulic cylinders which are arranged in between the frame of said machine and the protective sump of said drum. When said hydraulic cylinders are activated by a circuit of pressurised oil which alternatively feeds their positive and negative chambers, they realise the shaking of said drum which is the sussultatory movement of the drum itself on a vertical plane.

Advantageously the scarifier machine of the invention, supplied with a shaking drum improves the milling effect on the soil to be crumbled and permits to reduce the working times.

Still advantageously it is possible to obtain a greater exploitation of the used power.

BRIEF DESCRIPTION OF THE DRAWINGS

The said purposes and advantages will be better pointed out during the description of some embodiments of the invention given as an example but not as a restriction and represented in the enclosed drawings where.

DESCRIPTION OF THE INVENTION

Figure 1:
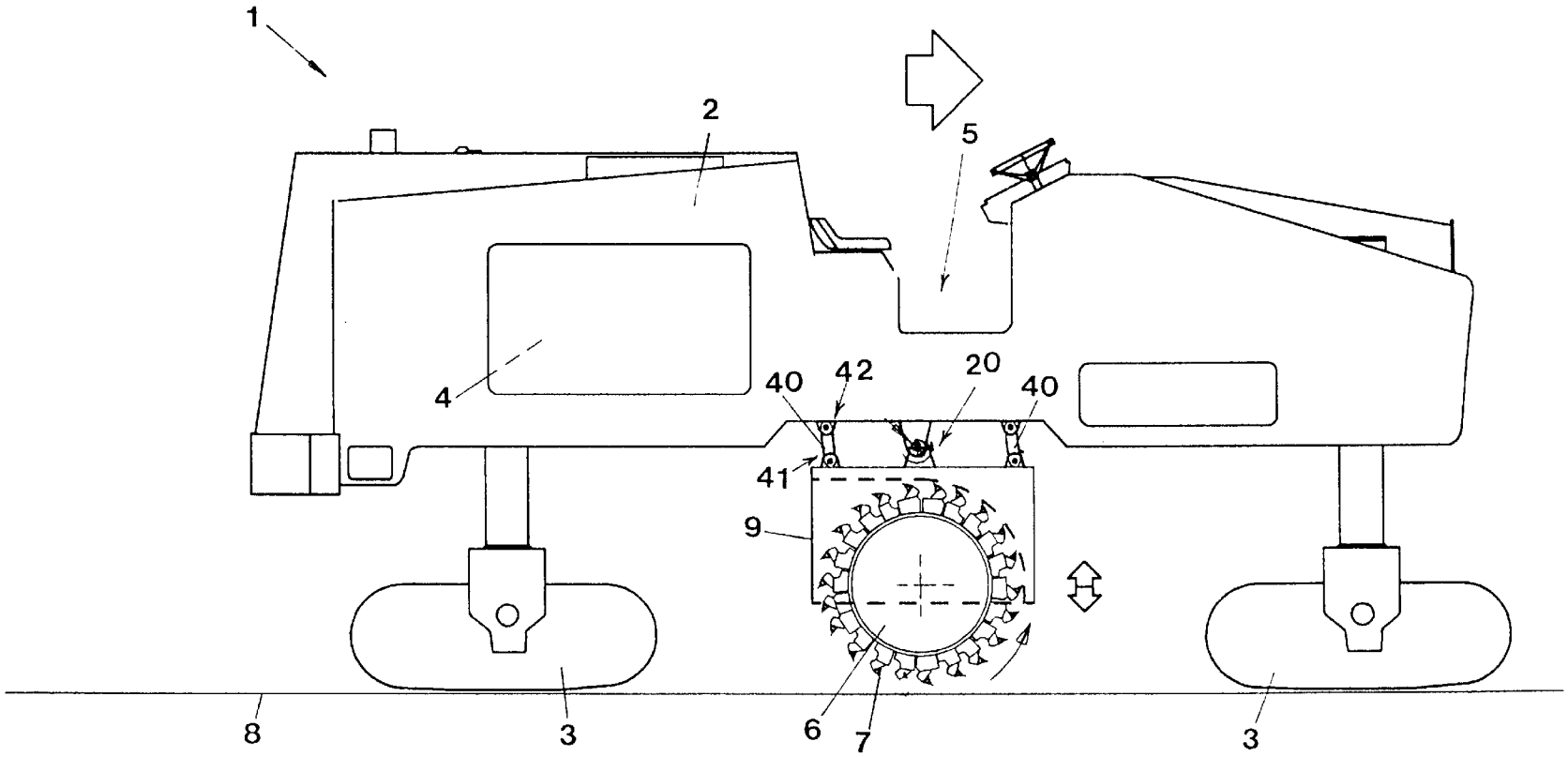
FIG. 1 shows the scarifier machine of the invention in a side view where the milling drum is supplied with said shaking means executed according to a first embodiment.
Figure 2:
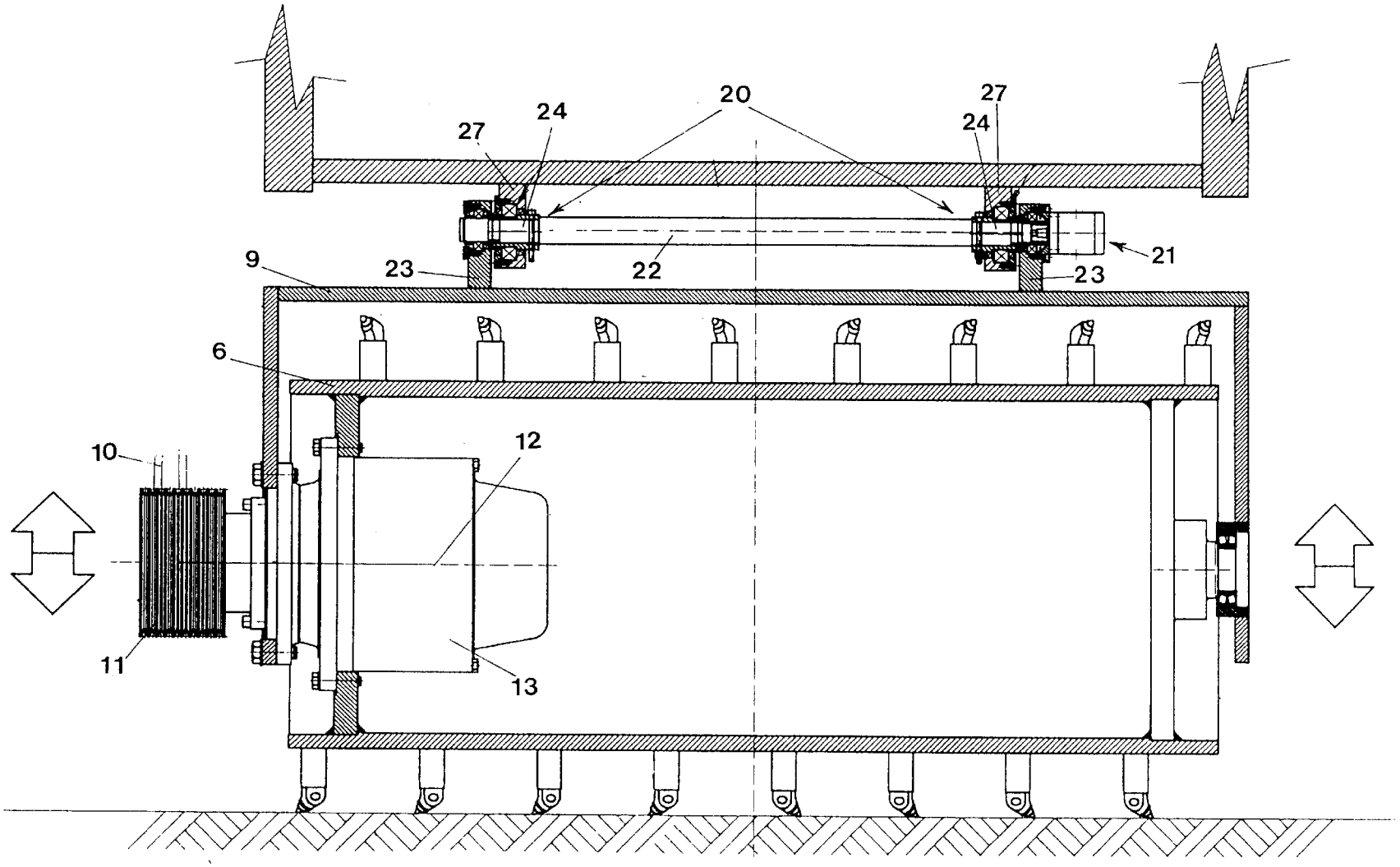
FIG. 2 shows the scarifier machine of FIG. 1 transversally sectioned according to a vertical plane which interests said shaking means.

As FIG. 1 shows the scarifier machine of the invention, indicated as a whole with 1 comprises:

- a frame 2 mounted on tracks 3 which supports a propelling group 4 and it is supplied with a driving place 5 which accommodates the driver;
- a milling drum 6 supplied with active elements 7 put in contact with the soil 8 to be removed and a protective sump 9 of said milling drum 6, mechanically connected with said frame 2;
- first motorization means (not represented) which, as FIG. 2 shows, are mechanically connected by driving belts 10 to a pulley 11 which is arranged coaxially to the longitudinal axis 12 of said milling drum 6 and which sets it in rotation by an epicyclical reduction gear 13.

It is clear that the scarifier machine could present a shape different from that described and represented in FIG. 1 and for example it could be supplied with wheels rather than with tracks, as the milling drum could be arranged in a position different from the substantially different position according to which it is represented in FIG. 1.

It can be observed that said protective sump 9 is mechanically connected with said frame by shaking means indicated as a whole with 20, which as FIG. 2 shows, cooperating with second motorization means, indicated as a whole with 21, permit to move said drum 6 in an alternating way in comparison with the soil to be worked.

Figure 3:
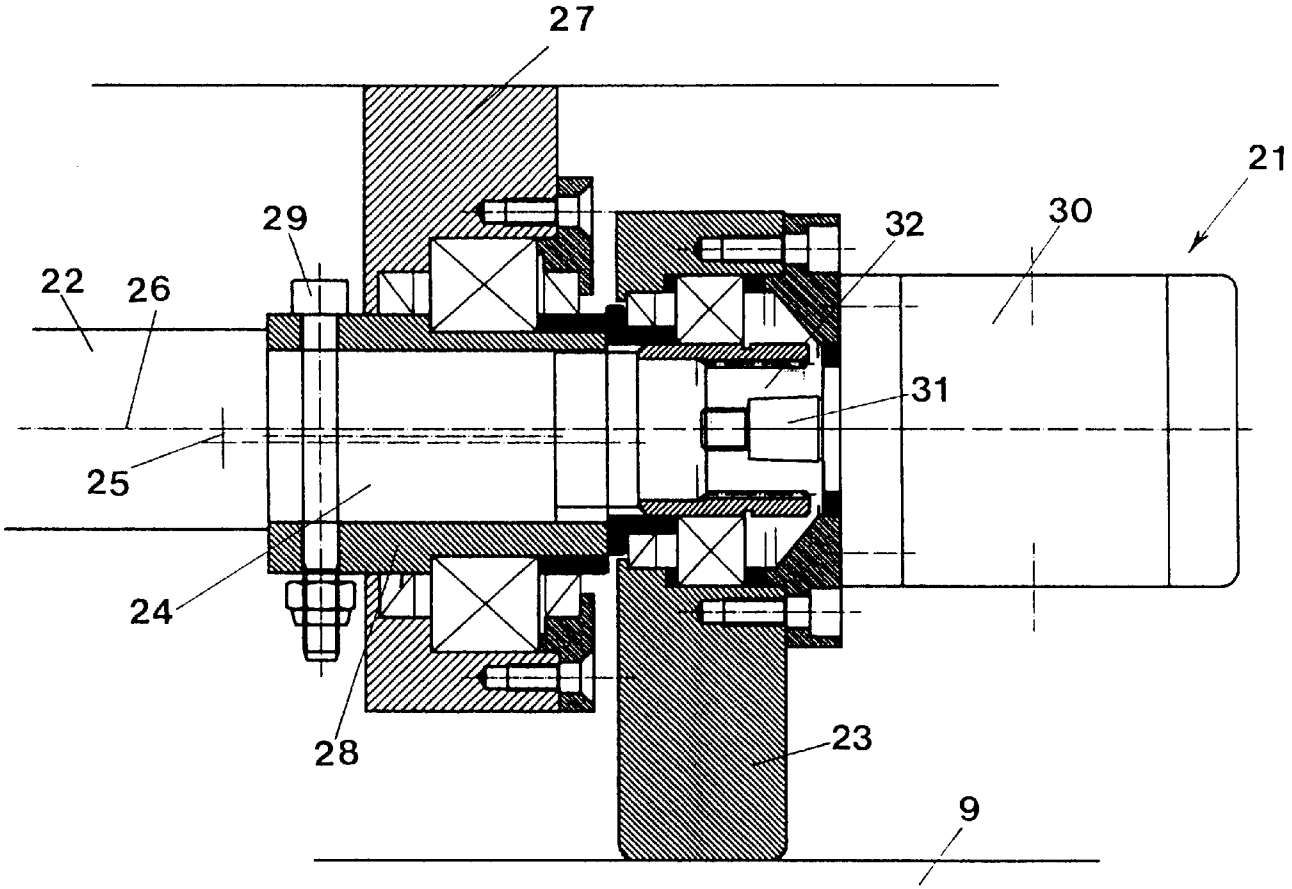
FIG. 3 shows the particular of said second motorization means which cooperate with said shaking means.

According to the embodiment represented in FIG. 1 and also in FIG. 2, said shaking means 20 comprise a cylindrical shaft 22 which is arranged in between two first supports 23 fixed to the sump 9 of the milling drum 6 and presents, as FIG. 3 shows more in details, two cylindrical zones 24 arranged with eccentricity 25 in comparison with the longitudinal axis 26 of the shaft 22 itself, being each of them received in a second support 27 fixed to the frame 2 of said machine. An eccentric manifold 28 which can be blocked in different angular positions by a screw 29, is interposed in between each eccentric zone 24 and the relative second support 27. In such a way it is possible to change the eccentricity of said second support 27 in comparison with the longitudinal axis 26 of the cylindrical shaft 22 in order to change the oscillation which is imparted to the milling drum 6 when said cylindrical shaft is set in rotation by second motorization means, indicated as a whole with 21.

In particular FIG. 3 shows that said second motorization means 21 are formed of a hydraulic engine 30 which is connected with said first support 23 fixed to said sump 9 and presents the driving shaft 31 coupled with the extremity 32 of said cylindrical shaft 22.

Said sump 9, as FIG. 1 shows, is connected with the frame 2 of the machine also by a couple of connecting rods 40 arranged in opposite parts of said shaking means 20 and in correspondence with each extremity of said sump 9, where each of said connecting rods presents a first extremity 41 hinged to said sump 9 and a second extremity 42 hinged to said frame 2. Said connecting rods realise an articulated four-sided and during the rotation of the milling drum 6, they guide it in the shaking movement which is imparted to it by the shaking means 20 and which is a combination of a oscillatory movement on a vertical plane with an undulatory movement on a horizontal plane.

Figure 4:
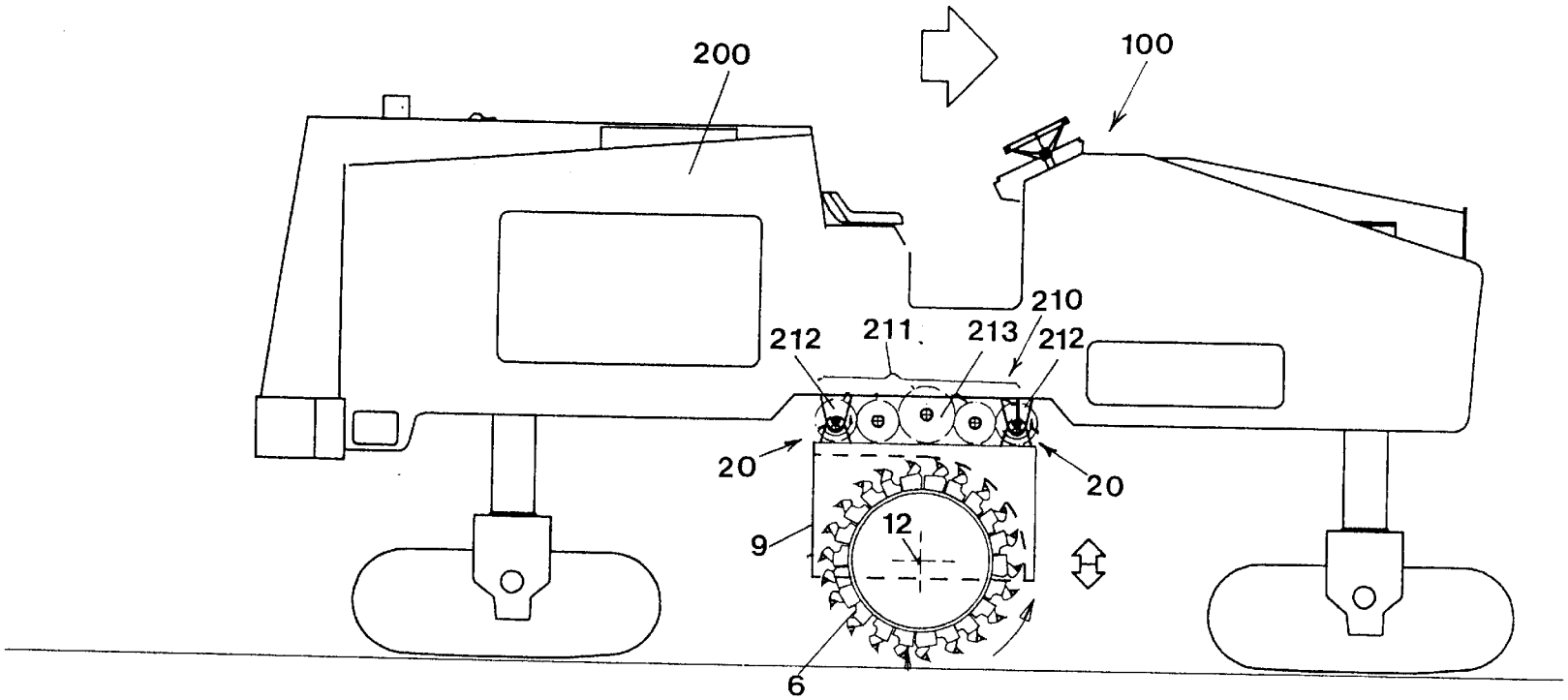
FIG. 4 shows the scarifier machine of the invention in a side view where said milling drum is supplied with said shaking means realised according to a further embodiment.

An executive variant of the scarifier machine of the invention, indicated as a whole with 100, is represented in FIG. 4 where it can be observed that the protective sump 9 of the milling drum 6 is applied to the frame 200 of the machine by a couple of the same shaking means indicated as a whole with 20 and previously described which, as it can be observed, present the cylindrical shaft 22 with which they are supplied, arranged parallel to one another and to the longitudinal axis 12 of the milling drum 6. It can also be observed that said cylindrical shafts 22 are set in rotation by second motorization means indicated as a whole with 210 which, as it can be observed, comprise a plurality of gear wheels 211 which engage one with the other where at least two of said gear wheels 212 are keyed, each of them to one of said cylindrical shafts 22 of said shaking means 20 and at least one of said gear wheels, for example the central gear wheel 213, is set in rotation by a hydraulic engine.

Figure 5:
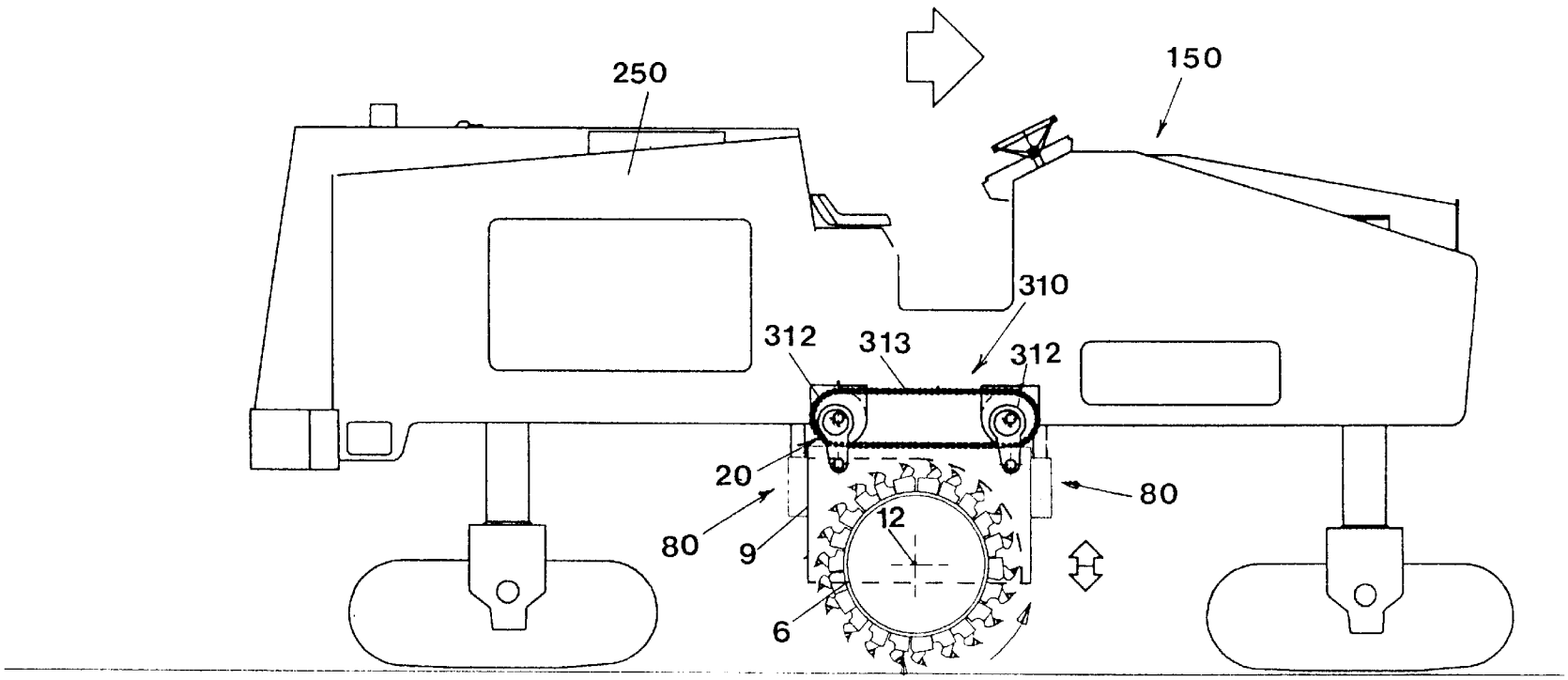
FIG. 5 shows the scarifier machine of the invention in a side view where said milling drum is supplied with said shaking means realised according to another embodiment.

According to another executive variant represented in FIG. 5 the scarifier machine of the invention, indicated as a whole with 150, includes that the protective sump 9 of the milling drum 6 is connected to the frame 250 of the machine itself by a couple of the same shaking means 20 previously described which, in this executive variant, present the cylindrical shafts 22 arranged parallel to one another and to the longitudinal axis 12 of the rotating drum 6 and are supplied with second motorization means, indicated as a whole with 310, which are formed by a couple of gear wheels 312 keyed to the cylindrical shaft 22 and connected with one another by a chain 313 which engages with both of them.

The rotation to said cylindrical shafts is imparted by an engine keyed to one of them.

The shaking of said milling drum 6 is controlled by prismatic guides 80 which, as it can be observed are interposed in between said protective sump 9 and said frame 250 of said scarifier machine.

Figure 6:
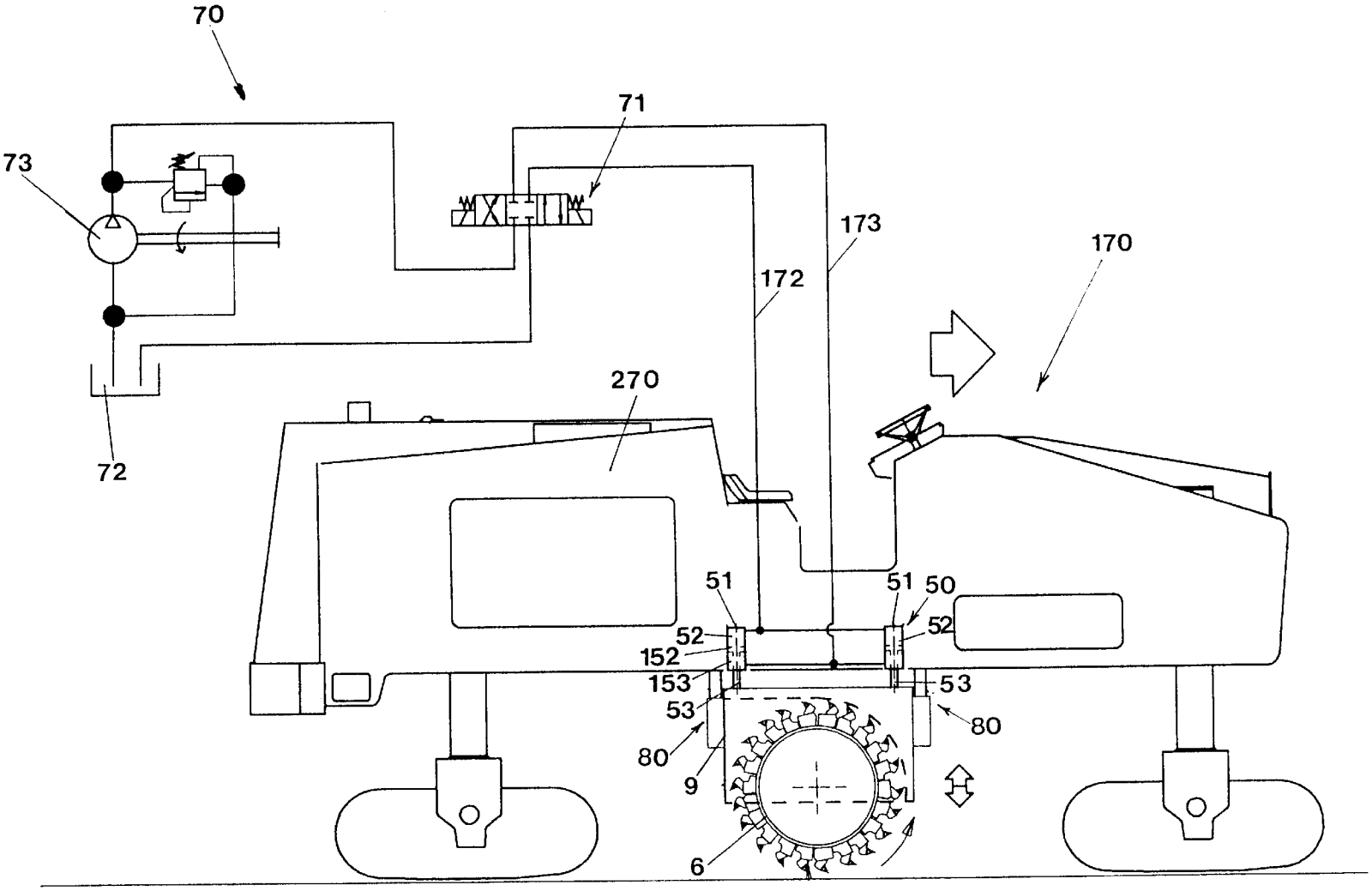
FIG. 6 shows the scarifier machine of the invention in a side view where said milling drum is supplied with said shaking means realised according to a further embodiment.

According to a further executive variant represented in FIG. 6, the scarifier machine of the invention, indicated as a whole with 170, includes that the protective sump 9 of the milling drum 6 is connected with the frame 270 of the machine itself by shaking means, indicated as a whole with 50 which, as it can be observed, are formed of a couple of hydraulic cylinders 51 each of them presenting the body 52 fixed to the frame 270 of the machine and the extremity 53 of the stem fixed to the protective sump of the milling drum 6.

In such variant of solution said second motorization means which set in motion said shaking means 50 are formed of a hydraulic circuit 70 which includes a distributor 71 suitable for conveying the pressurised oil coming from a tank 72 by a pump 73, alternatively in the positive chamber 152 and in the negative chamber 153 of each hydraulic cylinder 51, by pipelines respectively 172 and 173 in order to obtain an oscillating vertical movement of the milling cylinder 6.

It can be observed that also in such variant of solution the shifting of said milling drum 6 is controlled by prismatic guides 80 which, as it can be observed, are interposed in between said protective sump 9 and said frame 270 of said scarifier machine.

Therefore it is possible to comprehend, on the base of what has been said and described, that the scarifier machine of the invention achieves the prefixed purpose of being provided with an oscillating milling drum in comparison with the soil to be worked, uniting therefore to the rotating motion of the milling drum around its own longitudinal axis, also a shaking movement.

This makes easy the crumbling work of the soil, permits to reduce the working times and improves the exploitation of the power of the machine.

It is clear that in other not described embodiments the shaking of the milling drum could be obtained even with means different from those described.

With regard to the milling drum itself, as it has already been said, it could be applied to the scarifier machine in different positions from those described and represented in the drawings and eventually the same scarifier machine could be provided of more than only one milling drum.

It is however clear that said variants and other possible not mentioned, are all to be considered protected by the present patent.

What is claimed is:

1. A scarifier machine for removing soil comprising:

a self-propelled frame;

at least one milling drum mounted for rotation about an axis, including active elements secured to the drum for contacting the soil to be removed;

a protective sump reciprocally connected to the frame for supporting the drum on the axis for motion on a curved path laterally and transversely of said axis;

a first motor connected to the milling drum for rotatably driving the drum about the axis;

a second motor:

shaking means operatively connected to the second motor and mechanically connecting the sump to the frame for reciprocating the sump, including a shaft having a longitudinal axis, a first support having proximal and distal ends, and being secured at the proximal end to the frame;

an eccentric mounted on and rotatably secured in the distal end of the first support for reciprocating the shaft relative to its longitudinal axis; and a second support having proximal and distal ends, the proximal end secured to the sump and the distal end coupled to the shaft for carrying the sump and milling drum together for synchronous relative motion.

2. A scarifier machine according to claim 1 wherein said shaking means comprises a cylindrical shaft mechanically connected to the second motor.

3. A scarifier machine for removing soil comprising:

a self-propelled frame;

at least one milling drum mounted for rotation about an axis, including active elements secured to the drum for contacting the soil to be removed;

a protective sump reciprocally connected to the frame for supporting the drum on the axis for motion on a curved path laterally and transversely of said axis;

a first motor connected to the milling drum for rotatably driving the drum about the axis;

a second motor;

shaking means operatively connected to the second motor and mechanically connecting the sump to the frame for reciprocating the sump;

including a cylindrical shaft having a longitudinal axis, a first support having proximal and distal ends, and being secured at the proximal end of the frame;

an eccentric mounted on and rotatably secured in the distal end of the first support for reciprocating the shaft relative to its longitudinal axis; and a second support having proximal and distal ends, the proximal end secured to the sump and the distal end coupled to the shaft for carrying the sump and milling drum together for synchronous relative motion.

4. A scarifier machine according to claim 3 further including a pair of connecting rods each having first and second extemities, the first extremity of each rod being hinged to the sump and the second extremity of each rod being hinged to the frame.

5. A scarifier machine according to claim 3 wherein the second motor comprises a hydraulic engine including a driving shaft coaxially keyed to the cylindrical shaft.

* * * * *